US008486281B2

(12) United States Patent
Feng et al.

(10) Patent No.: US 8,486,281 B2
(45) Date of Patent: Jul. 16, 2013

(54) NICKEL-CHROMIUM ALLOY STRIPPER FOR FLEXIBLE WIRING BOARDS

(76) Inventors: Kesheng Feng, Cheshire, CT (US); Nilesh Kapadia, Shelton, CT (US); Steven A. Castaldi, Torrington, CT (US); John Ganjei, Southbury, CT (US)

( * ) Notice: Subject to any disclaimer, the term of this patent is extended or adjusted under 35 U.S.C. 154(b) by 747 days.

(21) Appl. No.: 12/573,298

(22) Filed: Oct. 5, 2009

(65) Prior Publication Data

US 2011/0079578 A1 Apr. 7, 2011

(51) Int. Cl.
*H01B 13/00* (2006.01)

(52) U.S. Cl.
USPC ..... 216/13; 216/100; 252/79.1; 438/745

(58) Field of Classification Search
USPC ... 174/255; 205/125, 138, 660, 674; 216/100, 216/105, 108, 12, 13, 55, 90; 252/79.3, 79.4; 29/846; 338/309; 427/259; 428/546, 626; 430/314; 438/745; 89/133
See application file for complete search history.

(56) References Cited

U.S. PATENT DOCUMENTS

| | | | | |
|---|---|---|---|---|
| 2,230,156 | A | 1/1941 | Carman | |
| 2,687,345 | A | 8/1954 | Murray | |
| 3,342,749 | A * | 9/1967 | Handleman et al. | 252/389.24 |
| 3,753,817 | A | 8/1973 | Geissler et al. | |
| 4,160,691 | A | 7/1979 | Abolafia et al. | |
| 4,283,248 | A | 8/1981 | Kakuhashi et al. | |
| 4,592,854 | A | 6/1986 | Lindner et al. | |
| 4,915,797 | A | 4/1990 | Vigezzi et al. | |
| 5,160,600 | A | 11/1992 | Patel et al. | |
| 6,045,713 | A | 4/2000 | Tamiya et al. | |
| 6,841,084 | B2 | 1/2005 | Lillie et al. | |
| 6,969,557 | B2 | 11/2005 | Matsuda et al. | |
| 7,285,229 | B2 | 10/2007 | Kuriyama et al. | |
| 7,495,177 | B2 | 2/2009 | Kataoka et al. | |
| 7,510,743 | B2 | 3/2009 | Subramanian | |
| 7,523,548 | B2 | 4/2009 | Kataoka et al. | |
| 2005/0016200 | A1 * | 1/2005 | Takao et al. | 62/430 |
| 2005/0061683 | A1 | 3/2005 | Hu et al. | |
| 2005/0109734 | A1 * | 5/2005 | Kuriyama et al. | 216/108 |

FOREIGN PATENT DOCUMENTS

| | | | |
|---|---|---|---|
| WO | 2007/040046 | A1 | 4/2007 |

* cited by examiner

*Primary Examiner* — Duy Deo
*Assistant Examiner* — Erin Bergner
(74) *Attorney, Agent, or Firm* — Carmody & Torrance LLP

(57) ABSTRACT

A nickel-chromium alloy etching composition comprising sulfuric acid, a source of chloride ions, including hydrochloric acid or sodium, potassium or ammonium chloride, and a sulfur compound comprising a sulfur atom with an oxidation state between −2 to +5, such as thiosulfate, sulfide, sulfite, bisulfite, metabisulfite and phosphorus pentasulfide that can efficiently remove nickel-chromium alloy in the presence of copper circuits is disclosed.

15 Claims, No Drawings

NICKEL-CHROMIUM ALLOY STRIPPER FOR FLEXIBLE WIRING BOARDS

FIELD OF THE INVENTION

The present invention relates generally to etching compositions for selectively etching flexible wiring boards without attacking copper surfaces thereon.

BACKGROUND OF THE INVENTION

For wiring boards used in electronic equipment, the demand for flexible wiring boards continues to increase due to their flexibility, thinness and lightweight. Flexible wiring boards are also used as a base material for semiconductor packages and for packages for liquid crystal modules. A typical construction of the flexible wiring board includes a polyimide film as an electrically insulating base material, a thin metal tiecoat, a copper seedcoat, and a layer of electrodeposited copper. The tiecoat and seedcoat layers can be applied, for example, using vacuum deposition techniques. The process involves a plasma pretreatment of the polyimide, sputter deposited tiecoat and seedcoat metals and electroplated copper. The tiecoat metal is typically either chromium or a nickel based alloy, which serves to enhance adhesion. The purpose of the copper seedcoat is to provide sufficient electrical conductivity to permit electroplating to a final copper thickness. Thereafter, the boards are processed through steps of photoimaging, etching and stripping to form fine line wiring boards.

The fine line wiring formation can be finished by either a single step etching process that involves photoimaging, etching copper and Ni/Cr alloy together and then stripping resist, or a two-step etching process that involves photoimaging, etching copper, stripping resist and thereafter etching Ni/Cr alloy.

The etching chemistries used for single step-etching have traditionally comprised cupric or ferric chloride/hydrochloric acid solutions or permanganate acid solutions. With photoresist leaching into cupric or ferric chloride/hydrochloride acid etchant, the etch rate for Ni/Cr alloy is generally slowed down. The process also has the potential to cause too much dissolution of copper. For permanganate acid etchant, Ni/Cr etch slows due to passivation by the $MnO_2$ reaction product, and a step of "neutralization" with oxalic acid or ascorbic acid removes $MnO_2$ is necessary to maintain good etch rates. To solve the issues resulting from single step etching, various two-step etching processes have also been developed, in which the Ni/Cr alloy is etched after the photoresist is stripped. This process needs to be selective, such that the etching solution removes the unwanted Ni/Cr alloy without attacking the copper.

Several patents for acidic chromium etching solutions have suggested these types of properties. For example, U.S. Pat. No. 2,230,156 to Carman, the subject matter of which is herein incorporated by reference in its entirety, describes a chromium etching solution containing hydrochloric acid and glycol, the glycol having more carbon atoms than hydroxyl groups and U.S. Pat. No. 2,687,345 to Murray, the subject matter of which is herein incorporated by reference in its entirety, describes a chromium etching solution containing calcium chloride and ethylene glycol. Furthermore, U.S. Pat. No. 4,160,691 to Abulafia et al., the subject matter of which is herein incorporated by reference in its entirety, describes a chromium etching solution containing hydrochloric acid and an aliphatic alcohol such as glycerin. All of the above solutions are acid chromium etching solutions, which supposedly remove chromium with little or no attack of the copper. Thus, these etchants are suitable for etching Ni/Cr alloy layers.

In addition, U.S. Pat. No. 6,841,084 to Lillie et al., the subject matter of which is herein incorporated by reference in its entirety, describes a process for etching an electrically resistive material comprised of a nickel chromium alloy for forming an embedded resistor. However, the etching rate of this solution decreases significantly as the following ratio increases: the surface area of copper-exposed to the etching solution (CsA) and the surface area of the Ni/Cr alloy exposed to the etching solution (RsA). This ratio (hereinafter referred to as the CSA/RSA ratio) can reach a value in which the etching of the Ni/Cr alloy is inhibited.

Moreover, it has been found that some Ni/Cr alloy etching solutions may dissolve surface treatments (including, but not limited to, adhesion-promoting treatments such as described in U.S. Pat. No. 6,969,557, to Matsuda et al., thermal barrier layer treatments such as described in U.S. Pat. No. 7,510,743 to Subramanian, stain proofing pretreating and resin resistant coating treatment, such as described in U.S. Pat. No. 4,915,797 to Vigezzi, et al., that are deposited on the copper surface to enhance the peel strength and shelf life of the resistive foil. This issue can be resolved, for example, by using an etching solution for etching an electrically resistive material, that include a nickel-chromium alloy, comprising hydrochloric acid and thiourea.

U.S. Pat. No. 7,285,229 to Kuriyama, the subject matter of which is herein incorporated by reference in its entirety, describes an etching method for selectively etching at least one metal selected from nickel, chromium, nickel-chromium and palladium. The etching method involves two etching solutions that contain hydrochloric acid, compounds with seven or less carbon atoms containing a sulfur atom, and thiazole. The amount of time that the metal needs to be in the etching solution is at least about 2 to 5 minutes.

Finally, International Patent Application No. WO2007/040046, the subject matter of which is herein incorporated by reference in its entirety, describes an etching solution for nickel-chromium alloy which is capable of sufficiently removing a nickel-chromium alloy layer and does not decrease in etching ability when the copper concentration in the etchant is increased during etching.

Etchants for nickel-chromium alloys are typically characterized by containing at least the following components: sulfuric or sulfonic acid, hydrochloric acid or a chlorine compound, and a nitrite.

It would be desirable to provide an improved solution for etching a nickel chromium alloy between copper circuits without detrimentally attacking copper.

To that end, the present invention provides an etching solution containing hydrochloric acid, an acid selected from the group consisting of sulfuric acid, phosphoric acid, nitric acid, sulfonic acid, sulfamic acid and combinations of one or more of the foregoing, and a sulfur compound that comprises a sulfur atom with an oxidation state between −2 and +5, including, but not limited to, compounds such as sulfites, thiosulfates and sulfides, to etch a tie coat layer or a resistive layer comprised of a nickel-chromium alloy.

SUMMARY OF THE INVENTION

It is an object of the present invention to provide a solution capable of etching a tiecoat material or an electrically resistive material between copper circuits without detrimentally attacking copper surfaces.

It is another object of the present invention to provide an etchant that improves the etching rate of a nickel-chromium alloy without detrimentally etching copper surfaces.

It is another object of the present invention to provide an etchant that suitably etches a nickel-chromium alloy when the CSA/RSA ratio is relatively large.

To that end, the present invention relates generally to a resistive etching composition for selectively etching a printed wiring board to remove a nickel-chromium alloy layer without detrimentally attacking copper, the resistive etching solution comprising:

a) an acid selected from the group consisting of sulfuric acid, phosphoric acid, nitric acid, sulfonic acid, sulfamic acid and combinations of one or more of the foregoing;

b) a source of halide ions; and c) a sulfur compound comprising a sulfur atom with an oxidation state between −2 and +5.

In another embodiment, the present invention relates generally to a method of selectively etching a flexible wiring board, wherein the flexible wiring board comprises an electrically insulating base material, a metal tie coat layer and a copper layer, the method comprising immersing the flexible wiring board in an etching solution capable of removing the metal tie coat layer without detrimentally attacking the copper layer, the etching solution comprising:

i) an acid selected from the group consisting of sulfuric acid, phosphoric acid, nitric acid, sulfonic acid, sulfamic acid and combinations of one or more of the foregoing;

ii) a source of halide ions; and iii) a sulfur compound comprising a sulfur atom with an oxidation state between −2 and +5;

for a period of time and at a temperature sufficient to remove the metal tie coat layer without detrimentally attacking the copper layer.

DETAILED DESCRIPTION OF THE PREFERRED EMBODIMENTS

In accordance with the present invention, there is provided an etching solution for etching a tiecoat material or an electrically resistive material such as a nickel-chromium alloy. The etching solution typically comprises a source of halide ions, an acid selected from the group consisting of sulfuric acid, phosphoric acid, nitric acid, sulfonic acid, sulfamic acid, and combinations of one or more of the foregoing, and a sulfur compound that comprises a sulfur atom with an oxidation state between −2 and +5, including, but not limited to, compounds of sulfite, thiosulfate and sulfide, for etching a tie coat layer or a resistive layer comprised of a nickel-chromium alloy. It was also determined that the addition of a compound with an azole group in the etching solution further improved the etching efficiency.

To that end, the present invention relates generally to an etching composition for selectively etching a printed wiring board to remove a nickel-chromium alloy layer without detrimentally attacking copper, the etching solution comprising:

a) an acid selected from the group consisting of sulfuric acid, phosphoric acid, nitric acid, sulfonic acid, sulfamic acid and combinations of one or more of the foregoing;

b) a source of halide ions; and c) a sulfur compound comprising a sulfur atom with an oxidation state between −2 and +5.

In one embodiment, the nickel-chromium alloy contains about 20% chromium and the thickness of the nickel-chromium alloy layer is typically between about 0.01 and 0.1 μm.

In one embodiment of the invention, the acid comprises sulfuric acid. The concentration of sulfuric acid in the etching composition is typically between about 200 and about 500 ml/liter of solution, more preferably in the range of between about 250 and about 400 ml/liter of solution, based upon concentrated 98% by weight sulfuric acid.

The source of halide ions may preferably be a source of chloride ions selected from the group consisting of hydrochloric acid, sodium chloride, potassium chloride, ammonium chloride and combinations of one or more of the foregoing.

The sulfur compound comprising a sulfur atom with an oxidation state between −2 and +5 preferably comprises a sulfur compound selected from the group consisting of sodium sulfide, potassium sulfide, ammonium sulfide, sodium bisulfide, potassium bisulfide, ammonium bisulfide, sodium sulfite, potassium sulfite, ammonium sulfite, sodium bisulfite, ammonium bisulfite, potassium bisulfite, sodium metabisulfite, potassium metabisulfite, ammonium metabisulfite, sodium thiosulfate, potassium thiosulfate, ammonium thiosulfate, phosphorus pentasulfide and combinations of one or more of the foregoing. In one embodiment the sulfur compound comprising a sulfur atom with an oxidation state in the range of −2 to +5 comprises sodium thiosulfate. In one embodiment, the concentration of the sulfur compound comprising a sulfur atom with an oxidation state in the range of −2 to +5 is between about 180 to about 500 ppm, more preferably within the range of about 190 to about 300 ppm.

The present invention also relates generally to a method of selectively etching a wiring board, wherein the flexible wiring board comprises an electrically insulating base material, a metal tie coat layer and a copper layer, the method comprising immersing the wiring board in an etching solution capable of removing the metal tie coat layer without detrimentally attacking the copper layer, the etching solution comprising:

i) an acid selected from the group consisting of sulfuric acid, phosphoric acid, nitric acid, sulfonic acid, sulfamic acid and combinations of one or more of the foregoing;

ii) a source of halide ions; and iii) a sulfur compound comprising a sulfur atom with an oxidation state in the range of −2 to +5;

for a period of time and at a temperature sufficient to remove the metal tie coat layer without attacking the copper layer.

The inventors of the present invention determined that the addition of a sulfur compound comprising a sulfur atom with an oxidation state between −2 and +5 increased the etching rate of Ni/Cr dramatically in a sulfuric acid/hydrochloric acid system while at the same time, creating no detrimental attack on the copper surface. In addition, the time for removing the Ni/Cr alloy was dramatically reduced to 0.5 to 1.0 minute (down from 2 to 5 minutes) once any of the sulfur compounds described herein were added into the acid solution.

EXAMPLES

Example 1

A solution comprising 240 ml/l of sulfuric acid (98%), 260 ml/l of hydrochloric acid (36%), and 500 ml/l of deionized water was heated to 50° C. The flexible wiring board coupon was immersed for one minute, and almost no etching on the Ni/Cr alloy was observed visually. Thereafter, 200 ppm of sodium thiosulfate was added into the solution. Ni/Cr alloy was etched away within 1 minute, and electron dispersive spectroscopy (EDS) could not detect any residue of Ni or Cr remaining

Example 2

A solution comprising 400 ml/l of sulfuric acid (98%), 600 ml/l of deionized water, 70 g/l of sodium chloride and 400 ppm of ammonium thiosulfate was heated to 50° C. The flexible wiring board coupon was immersed in the solution and within 1 minute, the Ni/Cr alloy was etched away. EDS could not detect any residue of Ni or Cr.

Example 3

A solution comprising 400 ml/l of sulfuric acid (98%), 540 ml/l of deionized water, 60 ml/l of hydrochloric acid and 300 ppm of phosphorus pentasulfide was heated to 50° C. The flexible wiring board coupon was immersed in the solution and within 1 minute, the Ni/Cr alloy was etched away. EDS could not detect any residue of Ni or Cr.

Example 4

A solution comprising 400 ml/l of sulfuric acid (98%), 540 ml/l of deionized water, 60 ml/l of hydrochloric acid and 200 ppm of sodium bisulfite was heated to 50° C. The flexible wiring board coupon was immersed in the solution and within 1 minute, the Ni/Cr alloy was etched away. EDS could not detect any residue of Ni or Cr.

Example 5

A solution comprising 400 ml/l of sulfuric acid (98%), 600 ml/l of deionized water, 60 ml/l of hydrochloric acid and 200 ppm of sodium bisulfide was heated to 50° C. The flexible wiring board coupon was immersed in the solution and within 1 minute, the Ni/Cr alloy was etched away. EDS could not detect any residue of Ni or Cr.

Based on these studies, various nickel/chromium etching solutions in accordance with the present invention were developed. In one embodiment, the solution of the invention may comprise about 100 to 500 ml/L of sulfuric acid, more preferably about 300 to about 400 ml/L sulfuric acid (98% w/w), about 50-70 ml/L of hydrochloric acid, more preferably about 60-65 ml/L of hydrochloric acid (36-38% w/w), 10-30 g/L of ammonium chloride, more preferably about 20 g/L of ammonium chloride, and 100-300 ppm, preferably about 200 ppm of the described sulfur compound. Other combinations of ingredients would also be usable in the practice of the invention.

The nickel-chromium alloy removal rate depends in part on the bath temperature. At about 45-50° C., the alloy can be removed within about 30 seconds. Under such conditions, the etch rate on copper was only about 1.0 to 2.0 μin.

Scanning electron microscopy (SEM) and electron dispersive spectroscopy (EDS) were used to check for any residue near copper circuits. When EDS was performed at a spot 2.0 μm from the copper circuit, none of the etched coupon showed any Ni/Cr residue except for the non-treated control coupon.

What is claimed is:

1. A method of selectively etching a wiring board, wherein the printed wiring board comprises an electrically insulating base material, a metal tie coat layer and a copper layer, the method comprising immersing the flexible wiring board in an etching solution comprising:

i) an acid selected from the group consisting of sulfuric acid, phosphoric acid, nitric acid, sulfonic acid, sulfamic acid and combinations of one or more of the foregoing;

ii) a source of halide ions; and iii) a sulfur compound comprising a sulfur atom with an oxidation state in the range of −2 to +5;

for a period of time and at a temperature sufficient to remove the metal tie coat layer wherein the metal tie coat layer comprises a nickel-chromium alloy and wherein the etch solution etches less than 2 μin of copper; and wherein the addition of the sulfur compound to the etch solution increases the etching rate of the nickel-chromium alloy while creating no detrimental attack on the copper layer, wherein the concentration of the sulfur compound is between about 180 to about 500 ppm.

2. The method according to claim 1 wherein the acid comprises sulfuric acid.

3. The method according to claim 1, wherein the etching solution is maintained a temperature of between about 45 to about 50° C.

4. The method according to claim 1, wherein the flexible wiring board is contacted with the etching solution for about 30 to about 90 seconds.

5. The method according to claim 1, wherein the source of halide ions is a source of chloride ions.

6. The method according to claim 5, wherein the source of chloride ions is selected from the group consisting of hydrochloric acid, sodium chloride, potassium chloride, ammonium chloride and combinations of one or more of the foregoing.

7. The method according to claim 1, wherein the sulfur compound comprises a sulfur compound selected from the group consisting of sodium sulfide, potassium sulfide, ammonium sulfide, sodium bisulfide, potassium bisulfide, ammonium bisulfide, sodium sulfite, potassium sulfite, ammonium sulfite, sodium bisulfite, ammonium bisulfite, potassium bisulfite, sodium metabisulfite, potassium metabisulfite, ammonium metabisulfite, sodium thiosulfate, potassium thiosulfate, ammonium thiosulfate, phosphorus pentasulfide and combinations of one or more of the foregoing.

8. The method according to claim 7, wherein the sulfur compound comprises sodium thiosulfate.

9. The method according to claim 2, wherein the concentration of sulfuric acid in the etching composition is between about 200 and about 500 ml/liter of solution.

10. The method according to claim 9, wherein the concentration of sulfuric acid in the etching composition is between about 250 and about 400 ml/liter of solution.

11. The method according to claim 1, wherein the concentration of the sulfur compound is between about 190 to about 300 ppm.

12. The method according to claim 1, wherein the sulfur compound comprises sodium sulfite.

13. The method according to claim 7, wherein the sulfur compound comprises phosphorus pentasulfide.

14. The method according to claim 7, wherein the sulfur compound comprises sodium bisulfite.

15. The method according to claim 7, wherein the sulfur compound comprises sodium bisulfide.

* * * * *